US009073075B2

(12) United States Patent
Chen

(10) Patent No.: US 9,073,075 B2
(45) Date of Patent: Jul. 7, 2015

(54) GARDEN SPRAYER

(71) Applicant: SHIN TAI SPURT WATER OF THE GARDEN TOOLS CO., LTD., Lu-Kang Town, Chang-Hua Hsin (TW)

(72) Inventor: Chin-Yuan Chen, Chang-Hua Hsien (TW)

(73) Assignee: SHIN TAI SPURT WATER OF THE GARDEN TOOLS CO., LTD., Chang-Hua Hsien (TW)

( * ) Notice: Subject to any disclaimer, the term of this patent is extended or adjusted under 35 U.S.C. 154(b) by 313 days.

(21) Appl. No.: 13/845,024

(22) Filed: Mar. 17, 2013

(65) Prior Publication Data

US 2014/0263745 A1 Sep. 18, 2014

(51) Int. Cl.

| | |
|---|---|
| ***B05B 15/08*** | (2006.01) |
| ***B05B 12/00*** | (2006.01) |
| ***B05B 1/30*** | (2006.01) |
| *B05B 1/16* | (2006.01) |

(52) U.S. Cl.

CPC ..... *B05B 12/002* (2013.01); *B05B 1/1654* (2013.01); *B05B 1/3026* (2013.01)

(58) Field of Classification Search

CPC ..... B05B 7/12; B05B 7/1218; B05B 7/1236
USPC ..... 239/587.1, 525, 526, 569, 581.1, 581.2, 239/581.3
See application file for complete search history.

(56) References Cited

U.S. PATENT DOCUMENTS

| | | | | |
|---|---|---|---|---|
| 6,173,911 | B1 * | 1/2001 | Hui-Chen | 239/526 |
| 6,427,931 | B1 * | 8/2002 | Guo | 239/526 |
| 6,719,219 | B1 * | 4/2004 | Wang | 239/526 |
| 7,328,860 | B1 * | 2/2008 | Chen | 239/581.1 |
| 2005/0001070 | A1 * | 1/2005 | Wu | 239/526 |

* cited by examiner

*Primary Examiner* — Davis Hwu

(57) ABSTRACT

A garden sprayer has a main body, a shaft, a positioning knob, a control member and a seal sleeve. Since the control member is driven by the rotation of the shaft, the user does not need to keep pressing the sprayer to output water. When the user needs to take a break, he or she can jus hook a gripping loop on any protruding object. With a connecting tube and the connecting hole, the assembly can be finished with any hand tools.

2 Claims, 6 Drawing Sheets

GARDEN SPRAYER

BACKGROUND OF THE INVENTION

1. Field of the Invention

The present invention relates to a garden sprayer, and more particularly to a garden sprayer which is capable of being controlled be fingers.

2. Description of the Related Art

Garden work requires watering plants, and proper tools are utilized for large areas such as water hoses or sprayer.

Typical garden sprayer requires continuous pressing force to control the water flow and amount, and a user needs to keep pressing down a switch, which can be uncomfortable after a long period of time.

Therefore, it is desirable to provide a garden sprayer to mitigate and/or obviate the aforementioned problems.

SUMMARY OF THE INVENTION

An objective of the present invention is to provide a garden sprayer which is capable of being controlled be fingers.

In order to achieve the above mentioned objective, A garden sprayer comprising: a main body, a shaft, a positioning knob, a control member and a seal sleeve, wherein: the main body has a handle and an inner chamber, the handle and the inner chamber are connected with each other and both covered by a protective cover; a first O-ring is disposed at a front end of the inner chamber such that the handle and the inner chamber together form the main body; the inner chamber utilizes a spray head base to pivotably connect to a spray head, a gripping loop disposed on the handle and the inner chamber; an upper end of the handle is provided with a water controlling chamber and the water controlling chamber is connected to a water inlet channel of the handle and a water outlet channel of the inner chamber; a guide slot is provided on an outer peripheral of the water controlling chamber, and two ends of the guiding slot are respectively provided with a stopping rib; a positioning member is disposed between the spray head and the spray head base; the shaft is provided with a guide opening with a predetermined angle on a side of an outer periphery, a through hole starts at a bottom end of the guide opening and ends at a side of the shaft, such that rotation of the shaft controls coverage of the through hole; an end of the shaft is provided with a circular slot jacketed with a second O-ring, and another end is provided with a connecting tube having a reduced diameter; the circular slot extends to form a first stopping edge, and two opposite inner faces of the stopping edge are respectively provided with a first positioning protrusion, the connecting tube provided with a flexible slot in a longitudinal direction and an engaging protrusion on at least two opposite portions on an outer periphery; an end of the positioning knob is provided with an enlarged second stopping edge and another end is provided with a connecting hole; an inner face of the stopping edge is provided with two second opposite positioning protrusions; an engaging aperture is respectively disposed above and below the connecting hole; the positioning knob further comprises a circular slot jacketed with a third O-ring; and the control member has two rotatable arms and a switch connected to the two rotatable arms, each rotatable arm is provided with a connecting aperture, and two opposite engaging slots are disposed on an edge of the connecting aperture.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
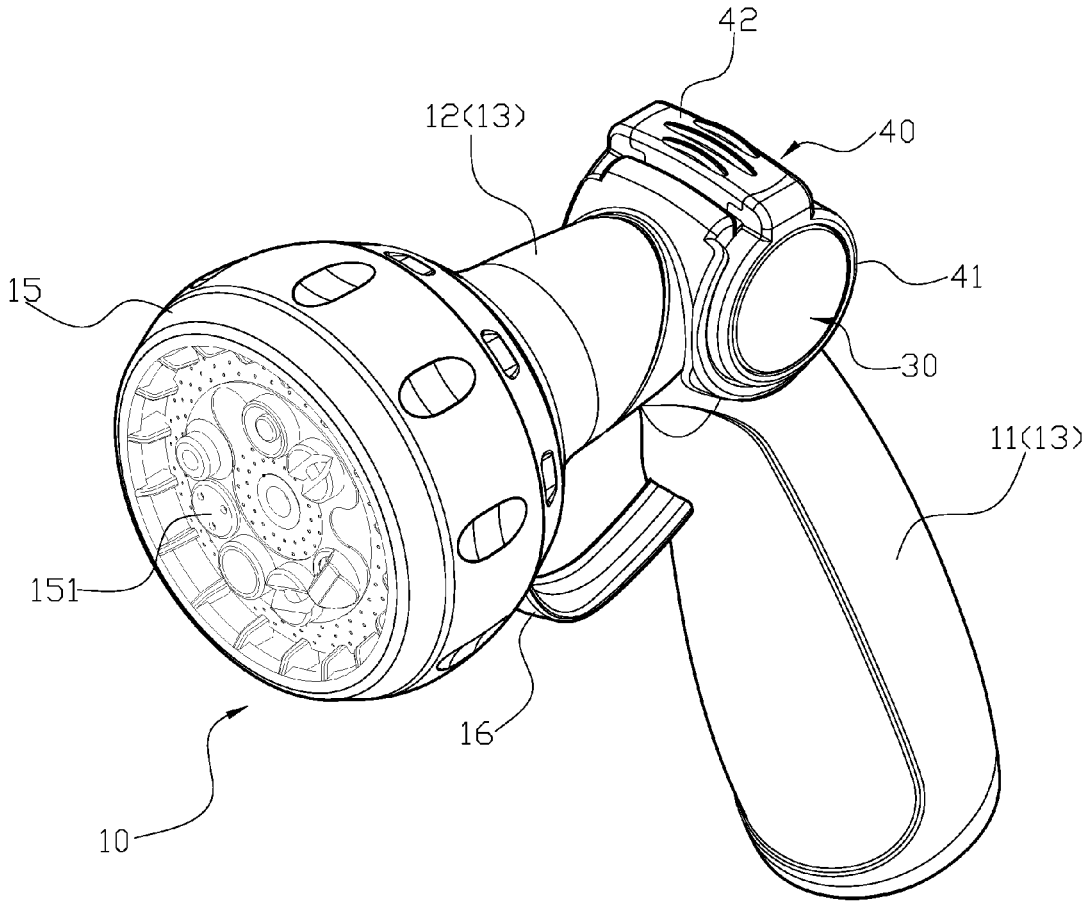
FIG. 1 is a perspective assembly drawing of a preferred embodiment of the present invention.
Figure 2:
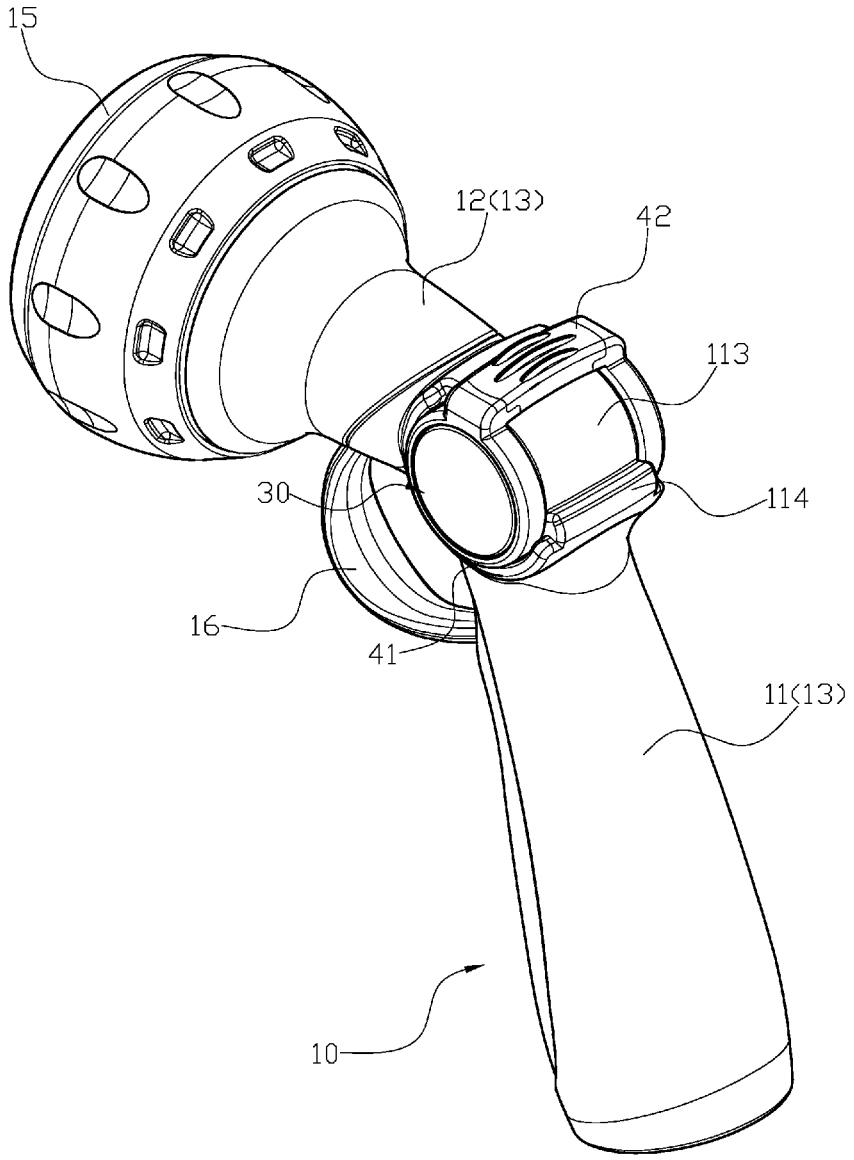
FIG. 2 is another perspective assembly drawing of the preferred embodiment of the present invention.
Figure 3:
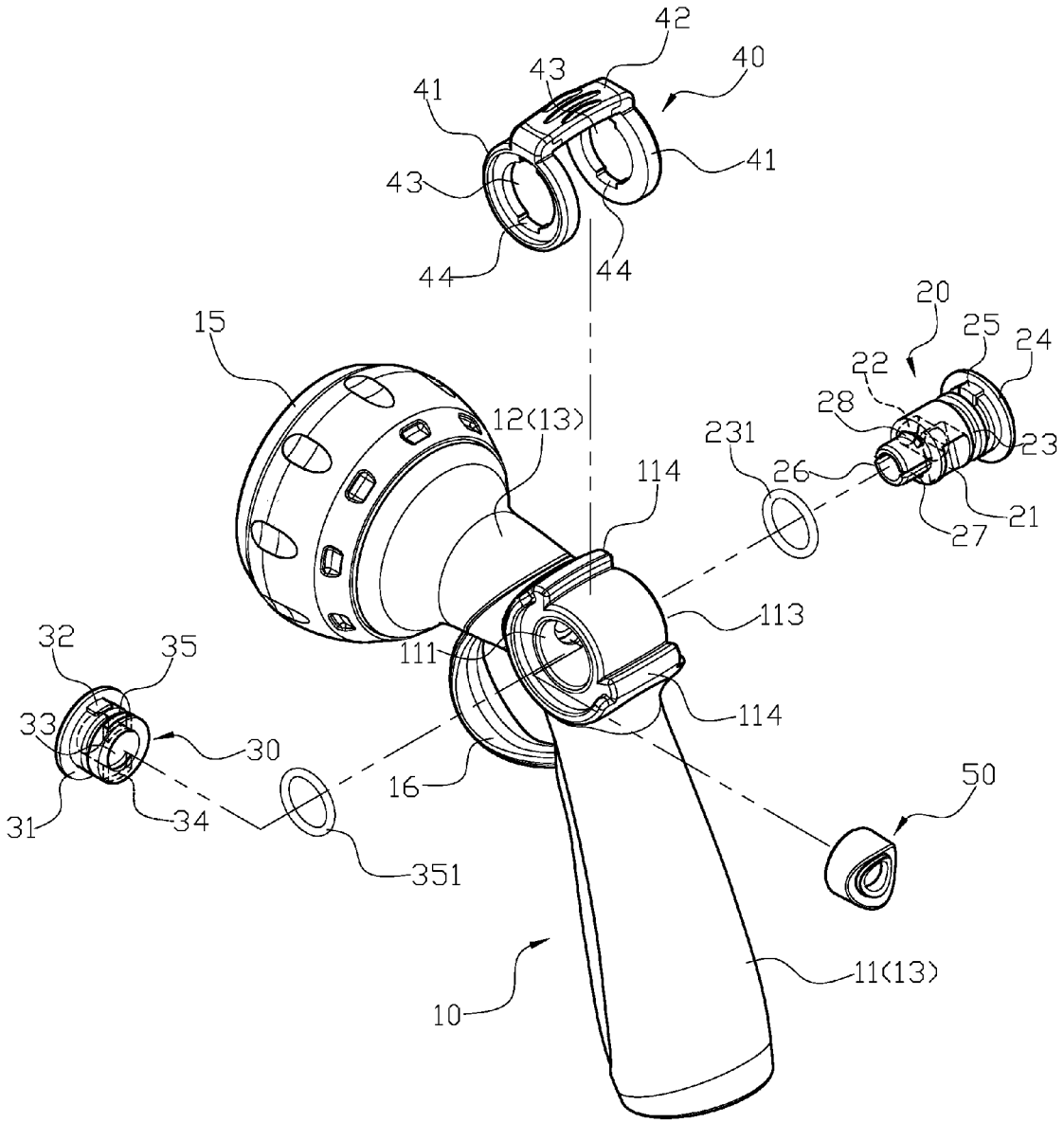
FIG. 3 is a perspective exploded drawing of the preferred embodiment of the present invention.
Figure 4:
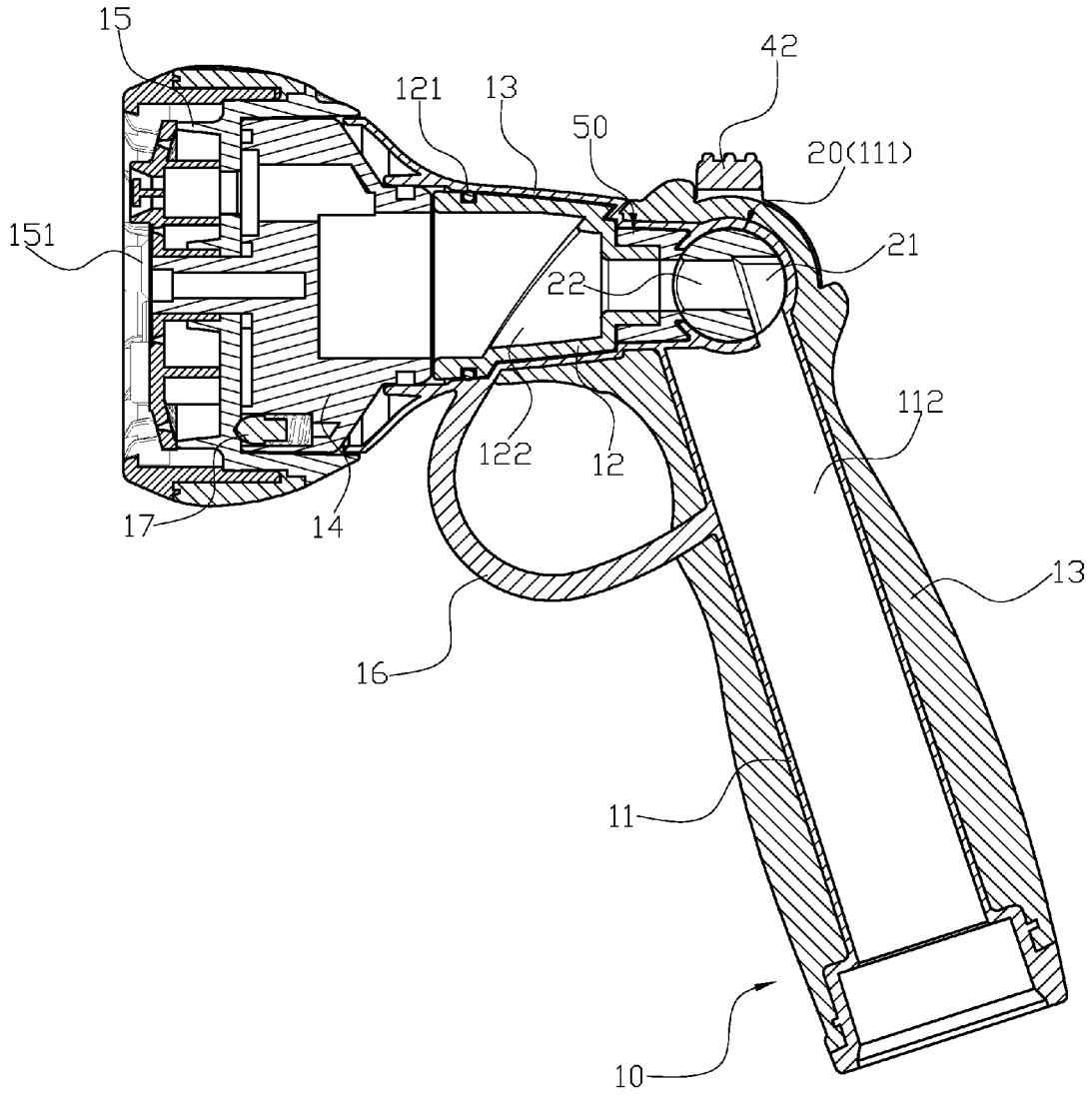
FIG. 4 is a detail cross-sectional drawing of the preferred embodiment of the present invention.
Figure 5:
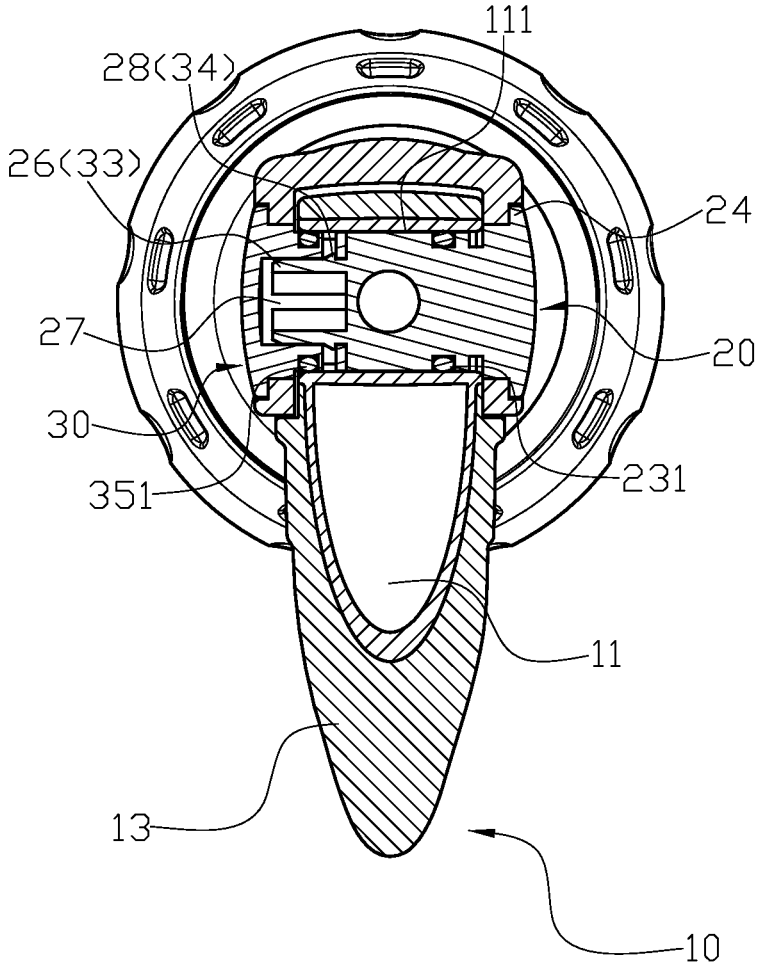
FIG. 5 is another detail cross-sectional drawing of the preferred embodiment of the present invention.

First, please refer to FIG. 1 to FIG. 5. The garden sprayer comprises: a main body 10, a shaft 20, a positioning knob 30, a control member 40 and a seal sleeve 50. The main body 10 has a handle 11 and an inner chamber 12, and the handle 11 and the inner chamber 12 are connected with each other and both covered by a protective cover 13. A first O-ring 121 is disposed at a front end of the inner chamber 12 such that the handle 11 and the inner chamber 12 together form the main body. The inner chamber 12 utilizes a spray head base 14 to pivotably connect to a spray head, 15, and a gripping loop 16 is disposed on the handle 11 and the inner chamber 12. An upper end of the handle 11 is provided with a water controlling chamber 111 and the water controlling chamber 111 is connected to a water inlet channel 112 of the handle 11 and a water outlet channel 122 of the inner chamber 12, which form a guiding channel. A guide slot 113 is provided on an outer peripheral of the water controlling chamber 111, and two ends of the guiding slot 113 are respectively provided with a stopping rib 114. A plurality of various spraying apertures 151 are provided on the spray head 15, and a positioning member 17 including at least one spring and at least one plunger is placed between the spray head 15 and the spray head base 14. The shaft 20 is provided with a guide opening 21 with a predetermined angle on a side of an outer periphery, a through hole 22 starts at a bottom end of the guide opening 21 and ends at a side of the shaft 20, such that rotation of the shaft 20 controls coverage of the through hole 22. An end of the shaft 20 is provided with a circular slot 23 jacketed with a second O-ring 231, and another end is provided with a connecting tube 26 having a reduced diameter. The circular slot 23 extends to form a stopping edge 24, and two opposite inner faces of the first stopping edge 24 are respectively provided with a first positioning protrusion 25. The connecting tube 26 is provided with a flexible slot 27 in a longitudinal direction and an engaging protrusion 28 on at least two opposite portions on an outer periphery. An end of the positioning knob 30 is provided with an enlarged second stopping edge 31 and another end is provided with a connecting hole 33. An inner face of the second stopping edge 31 is provided with two opposite second positioning protrusions 32. An engaging aperture 34 is respectively disposed above and below the connecting hole 33. The positioning knob 30 further comprises a circular slot 35 jacketed with a third O-ring 351. The control member 40 has two rotatable arms 41 and a switch 42 connected to the two rotatable arms 41. Each rotatable arm 41 is provided with a connecting aperture 43, and two opposite engaging slots 44 are disposed on an edge of the connecting aperture 43

For structure assembly, please refer to FIG. 1, FIG. 2, FIG. 4 and FIG. 5. The seal sleeve 50 is placed in the main body 10 and positioned between the water controlling chamber 111 and the inner chamber 12. The two rotatable arms 41 of the control member 40 respectively make contact with two outer sides of the water controlling chamber 111 such that the switch 42 is positioned and rotatable in the guiding slot 113. The connecting tube 26 of the shaft 20 is placed through the connecting aperture 43 of one of the rotatable arms 41 and passes through the water controlling chamber 111 to engage with the connecting hole 33 of the positioning knob 30. When the connecting hole 33 pushes against the engaging protrusion 28, the connecting tube 26 tapers inwardly due to the flexible slot 27. When the engaging protrusion 28 is aligned with the engaging aperture 34, the connecting tube 26 is urged back to cause the engaging protrusion 28 to engage with the engaging aperture 34. Meanwhile, the first stopping edge 24 of the shaft 20 engages with the second stopping edge 31 of the positioning knob 30 in the connecting aperture 43 of the two rotatable arms 41, and the first and second positioning protrusions 24, 31 engages with the engaging slot 44 of the control member 40, such that the shaft 20 and the positioning knob 30 are interlinked with each other.

Figure 6:
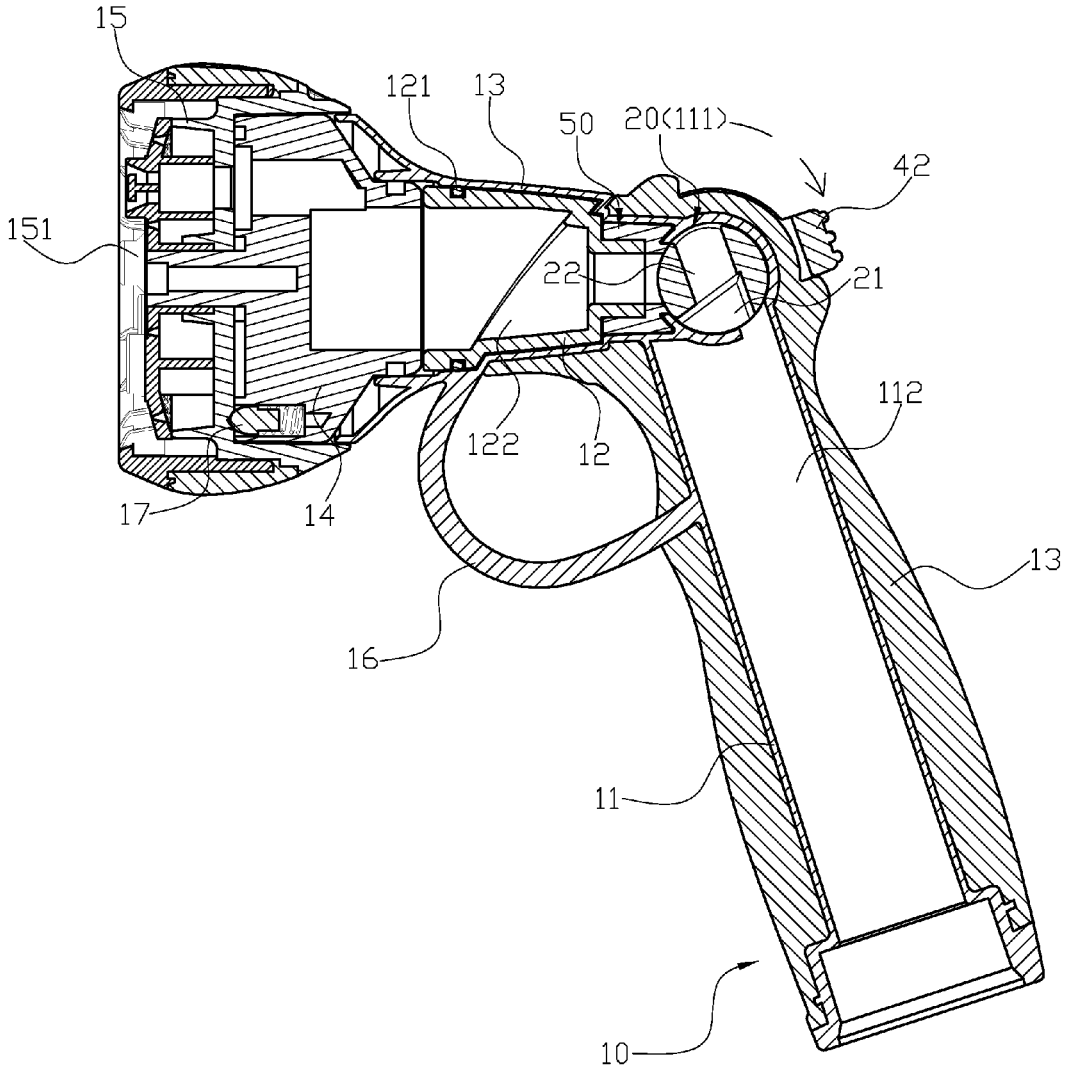
FIG. 6 is a schematic drawing of the garden sprayer stopping supplying water according to the present invention.

For actual usage, the water inlet channel 112 of the handle 11 is connected to a water pipe to let water flow from the water inlet channel 112 into the water controlling chamber 111, then passes through the guide opening 21 of the shaft 20, the through hole 22, the water outlet channel 122 of the inner chamber 12, the spray head base 14, to exit from the spraying apertures 151 of the spray head 15. In order to change an outputting water amount or to turn off water, as shown in FIG. 6, the switch 42 needs to be pushed to engage with the guiding slot 113, with the engagement between the engaging slot 44 and the first and second positioning protrusions 25, 32, the shaft 20 and the positioning knob 30 together rotates with the control member 40, and due to the offset between the through hole 22 and the water outlet channel 122, a sidewall of the water controlling chamber 111 corves different portion of the through hole 22, which can change the outputting water amount.

With the above-mentioned structure, following benefits can be obtained: 1. Since the control member 40 is driven by the rotation of the shaft 20, the user does not need to keep pressing the sprayer to output water. 2. When the user needs to take a break, he or she can jus hook the gripping loop 16 on any protruding object. 3. With the connecting tube 26 and the connecting hole 33, the assembly can be finished with any hand tools.

Although the present invention has been explained in relation to its preferred embodiment, it is to be understood that many other possible modifications and variations can be made without departing from the spirit and scope of the invention as hereinafter claimed.

What is claimed is:

1. A garden sprayer comprising: a main body, a shaft, a positioning knob, a control member and a seal sleeve, wherein:

the main body has a handle and an inner chamber, the handle and the inner chamber are connected with each other and both covered by a protective cover;

a first O-ring is disposed at a front end of the inner chamber such that the handle and the inner chamber together form the main body;

the inner chamber utilizes a spray head base to pivotably connect to a spray head, a gripping loop disposed on the handle and the inner chamber;

an upper end of the handle is provided with a water controlling chamber and the water controlling chamber is connected to a water inlet channel of the handle and a water outlet channel of the inner chamber;

a guide slot is provided on an outer peripheral of the water controlling chamber, and two ends of the guiding slot are respectively provided with a stopping rib;

a positioning member is disposed between the spray head and the spray head base;

the shaft is provided with a guide opening with a predetermined angle on a side of an outer periphery, a through hole starts at a bottom end of the guide opening and ends at a side of the shaft, such that rotation of the shaft controls coverage of the through hole; an end of the shaft is provided with a circular slot jacketed with a second O-ring, and another end is provided with a connecting tube having a reduced diameter; the circular slot extends to form a first stopping edge, and two opposite inner faces of the stopping edge are respectively provided with a first positioning protrusion, the connecting tube provided with a flexible slot in a longitudinal direction and an engaging protrusion on at least two opposite portions on an outer periphery;

an end of the positioning knob is provided with an enlarged second stopping edge and another end is provided with a connecting hole; an inner face of the stopping edge is provided with two second opposite positioning protrusions; an engaging aperture is respectively disposed above and below the connecting hole; the positioning knob further comprises a circular slot jacketed with a third O-ring;

the control member has two rotatable arms and a switch connected to the two rotatable arms, each rotatable arm is provided with a connecting aperture, and two opposite engaging slots are disposed on an edge of the connecting aperture;

wherein the seal sleeve is placed in the main body and positioned between the water controlling chamber and the inner chamber; the two rotatable arms of the control member respectively make contact with two outer sides of the water controlling chamber such that the switch is positioned and rotatable in the guiding slot; the connecting tube of the shaft is placed through the connecting aperture of one of the rotatable arms and passes through the water controlling chamber to engage with the connecting hole of the positioning knob; when the connecting hole pushes against the engaging protrusion, the connecting tube tapers inwardly due to the flexible slot; when the engaging protrusion is aligned with the engaging aperture, the connecting tube is urged back to cause the engaging protrusion to engage with the engaging aperture; meanwhile, the first stopping edge of the shaft engages with the second stopping edge of the positioning knob in the connecting aperture of the two rotatable arms, and the first and second positioning protrusions engages with the engaging slot of the control member, such that the shaft and the positioning knob are interlinked with each other.

2. The garden sprayer as claimed in claim 1, wherein the positioning member including at least one spring and at least one plunger is placed between the sprayer head and the spray head base.

* * * * *